US005268828A

United States Patent [19]

Miura

[11] Patent Number: 5,268,828

[45] Date of Patent: Dec. 7, 1993

[54] ILLUMINANT DISPLAY DEVICE

[75] Inventor: Masanobu Miura, Osaka, Japan

[73] Assignee: Takiron Co., Ltd., Osaka, Japan

[21] Appl. No.: 868,772

[22] Filed: Apr. 15, 1992

[30] Foreign Application Priority Data

Apr. 19, 1991 [JP] Japan ..... 3-36144[U]
Nov. 29, 1991 [JP] Japan ..... 3-106516[U]
Feb. 25, 1992 [JP] Japan ..... 4-17972[U]

[51] Int. Cl.[5] ..... F21V 21/00

[52] U.S. Cl. ..... 362/249; 362/252; 362/800; 362/812; 40/550

[58] Field of Search ..... 362/800, 249, 252, 812; 313/500; 40/550, 544; 340/766

[56] References Cited

U.S. PATENT DOCUMENTS 5,003,233 3/1991 Proud et al. ..... 40/550
5,036,248 7/1991 McEwan et al. ..... 313/500

FOREIGN PATENT DOCUMENTS 8604439 7/1986 PCT Int'l Appl. .

*Primary Examiner*—Carroll B. Dority
*Attorney, Agent, or Firm*—Sughrue, Mion, Zinn, Macpeak & Seas

[57] ABSTRACT

An illuminant display device having a wired substrate with a large number of LEDs mounted thereon, and a case frame member for accommodating the wired substrate. An illuminant dot being composed of a plurality of the LEDs and a plurality of the illuminant dots being aligned in a horizontal direction in each case frame member. A plurality of the illuminant display devices are arranged in a matrix form to form a large-scale display unit. Alignment of the illuminant display devices in a horizontal direction is easily and accurately maintained.

7 Claims, 15 Drawing Sheets

ILLUMINANT DISPLAY DEVICE

BACKGROUND OF THE INVENTION

1) Field of the Invention

The present invention relates to an illuminant display device which is used to construct a large-sized display unit which employs LED illuminant elements as its light emitting sources and is installed mainly outdoors.

2) Description of the Related Art

As a large-sized display unit, conventionally, there is known such a display unit as shown in FIG. 1. In such a device an LED illuminant element 100 is sealed by a transparent resin 101 which has a spherical leading end portion and serves as a circular convex lens to thereby form an LED lamp 103 having an electrode lead extending therefrom. A large number of LED lamps 103 are wired to and mounted on a wired substrate 102 and the wired substrate 102 is mounted in a case 104 the front surface of which is opened in a round or square shape so as to form an LED combined lamp device 105. The LED combined lamp devices 105 are arranged vertically and horizontally and are then respectively mounted to a box member 107 to be located on the outer wall of a building, for example, by use of stop members 106 to thereby form a large display screen. The display screen is controllably turned on and off with each of the LED combined lamp devices 105 as one illuminant dot so as to be able to display desired characters, symbols and the like.

However, in the above-mentioned conventional display unit, when a large number of LED combined lamp devices 105 are arranged vertically and horizontally and mounted onto the box member 107, respectively, at least the optical axes of the respective LED combined lamp devices 105 arranged in vertical and horizontal lines must be aligned substantially to a view position, from the viewpoint of visibility. For this reason, as the number of the LED combined lamp devices 105 to be mounted increases, it is more troublesome to coincide the optical axes of the individual LED combined lamp devices 105 arranged in horizontal lines with the view position to when mounting combined lamp devices 105 by use of the stop members 106.

Also, when the display unit is installed onto the wall of a building and the like in consideration of the visibility at the practical view position, the mounting surface of the box member 107 for mounting the respective LED combined lamp devices 105 must be previously machined such that it is inclined at a desired angle so as to be able to obtain a desired angle of view. Or, in order to be able to obtain a desired angle of view when the respective LED combined lamp devices 105 are mounted, various cases 104 having different mounting angles must be prepared. This makes it complicated to machine the box member 107 when the respective LED combined lamp devices 105 must be mounted to the box member 107 in such a manner to be able to obtain a desired angle of view at the practical view position, resulting in installation increased costs.

Further, the above-mentioned conventional display unit is disadvantageous in that, when turning on the lamp bodies to display desired characters, symbols and the like respectively constructed by illuminant dots, a visor portion of the case 104 blocks the incidence of the sunlight into the illuminant dots to enhance the relative illuminous brightnesses of the dots with respect to the external brightness and to improve the display contrast of the dots, while heat generated by the respective LED lamps 103 of the individual LED combined lamp devices 105 disposed on the wired substrate 102 is radiated into the ambient air, with the result that the temperature of the air in the case 104 is caused to rise. The thus elevated hot air is caused to flow in such a way as shown by a one-dot chained line in FIG. 1 due to the existence of the visor portion. That is, the hot air tends to remain within the case 104 and is not so that the case is well ventilated. For this reason, the heat radiation and convection of the case 104 is bindered resulting in elevating the ambient air temperature within the case 104, which in turn raises the temperature of the LED lamps 103. This results in an a degradation of the illuminant properties and in shortening of the life periods of the lamps 103.

SUMMARY OF THE INVENTION

Accordingly, an object of the present invention is to provide an illuminant display device having an optical axis which can be adjusted readily and accurately.

Another object of the present invention is to provide a structure for mounting a plurality of illuminant display devices to a box member with a desired viewing angle with accuracy and ease.

A still further object of the present invention is to provide an illuminant display device capable of preventing problems which are caused by heat generated by luminance elements of the device.

The above, and other objects of the present invention are accomplished by the provision of an illuminant display device having a wired substrate with a large number of LEDs mounted thereon and a case frame member for accommodating the wired substrate. An illuminant dot is composed of a plurality of the LEDs and a plurality of illuminant dots are aligned in a horizontal direction.

In the illuminant display device according to the present invention. At least two stop member insertion holes each of which has a cross section enlarged vertically toward the rear end aperture thereof are formed to a back plate of the case frame member, at least one spacer having a wedge-shaped section is interposed between the back plate of the case frame member and a box member for accommodating a plurality of the illuminant display devices so as to arrange the case frame member in an inclined state, and fixing members are threadedly engaged through the stop member insertion holes at right angles with the box member to fix the illuminant display device to the box member.

Further, with an illuminant device of the present invention, the case frame member has a visor, to block external light, having plurality of through holes for ventilation.

DESCRIPTION OF THE PREFERRED EMBODIMENTS

Now, description will be given below of embodiments of an illuminant display device according to the present invention with reference to the accompanying drawings.

Figure 1:
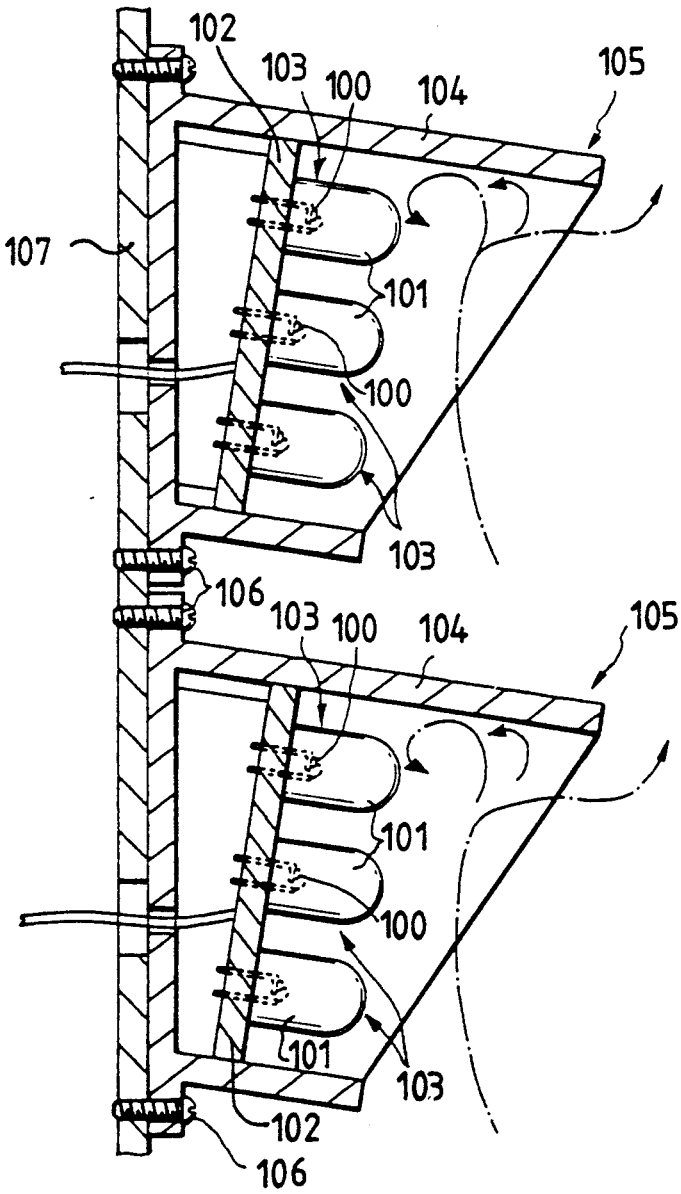
FIG. 1 is a schematic longitudinal section view, enlarged in part, of a conventional illuminant display device mounting structure.
Figure 2:
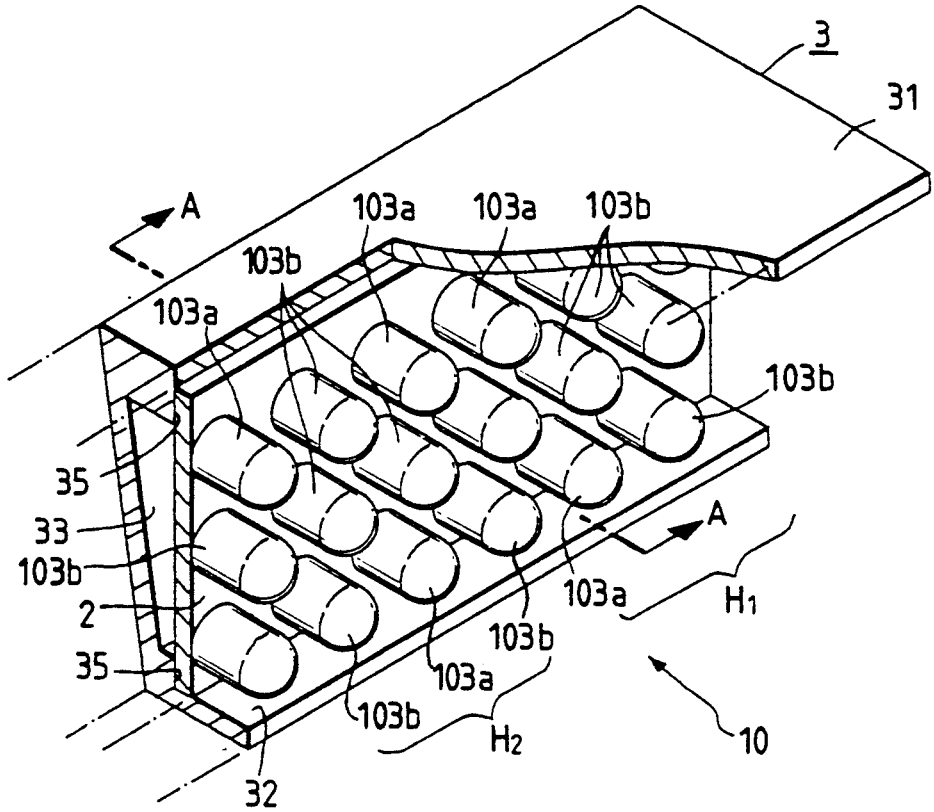
FIG. 2 is a perspective view, broken in part, of a first embodiment of an illuminant display device according to the present invention.
Figure 3:
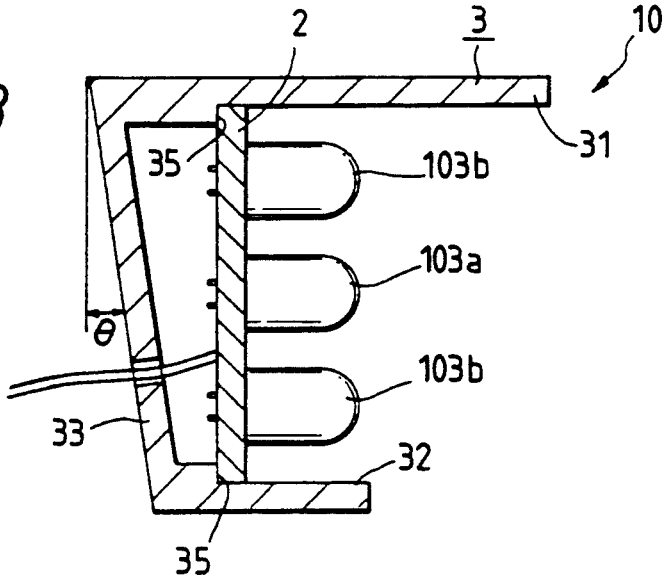
FIG. 3 is an enlarged partial section view of the above illuminant display device, taken along the line A—A in FIG. 1.

In FIG. 2, is a perspective view, in partial section, of a first embodiment of an illuminant display device according to the present invention and, FIG. 3, is an enlarged sectional view of the illuminant display device taken along the line A—A in FIG. 2.

To construct an illuminant display device 10 in this embodiment, a large number of LED lamps 103*a*, 103*b* having different display colors are disposed on, for example, a wired substrate 2 which is rectangular in shape. The LED lamps 103*a*, 103*b*, arranged in three vertical lines and in three horizontal lines are used to form one illuminant dot H1, H2, . . . to thereby provide n pieces of illuminant dots in a horizontal line the wired substrate 2 is mounted in a case frame member 3 having an open front surface.

As the above-mentioned LED lamps 103*a*, 103*b*, conventional ones can be used and thus the description of the structure of the LED lamp is omitted here. According to the present invention, for example, three red LED lamps 103*a* and six green LED lamps 103*b*, that is, a total of nine LED lamps are disposed to provide n pieces of illuminant dots in a horizontal line respectively, each illuminant dot H1 . . . including the LED lamps 103*a*, 103*b*. In this case, the positions and combinations of the illuminant colors of the LED lamps 103*a*, 103*b* forming one illuminant dot H1 . . . as well as the number of the LED lamps 103*a*, 103*b* may vary and are determined according to the dot size and the like. Here, the illuminant display device of the present invention is suitable for a large-sized dot having a dot pitch of at least 15 mm to about 150 mm. In this case, the number of the LED illuminant chips or lamps 103*a*, 103*b* to be disposed in one illuminant dot H1, H2 . . . is on the order of 5–100. Also, the number of the illuminant dots to be arranged in horizontal lines may be on the order of 4–16. Further the wired substrate 2 disposed in the case frame member 3, alternatively, may also be divided into two or more sections.

Figure 4:
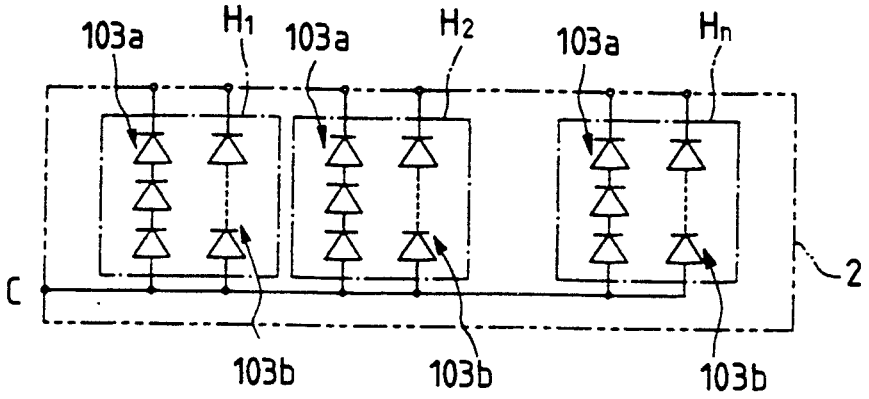
FIG. 4 is a circuit diagram employed in the present illuminant display device.

The above-mentioned wired substrate 2 is a print substrate consisting mainly of glass epoxy resin, paper phenol or the like. The above-mentioned respective LED lamps 103*a*, 103*b* are disposed on the wired substrate 2 to thereby provide a lighting circuit as shown in FIG. 4. In other words, in the lighting circuit, the LED lamps 103*a*, 103*b* in each of the illuminant dots Hl–Hn respectively emitting lights with the same color are respectively connected to one another in series, the anode sides of the series convection, for example, are wired in common to provide a common terminal, the cathode sides of the respective LED lamps 103*a*, 103*b* in each of the illuminant dots Hl–Hn are used as their terminals so as to be connectable to a wired plate (not shown) which is provided externally for other lighting control purpose. If the anode sides of the respective LED lamps 103*a*, 103*b* are all internally connected to the common terminal in this manner, then the number of wires guided externally can be reduced. In this circuit configuration, with the anode sides of the LED lamps connect at the common terminal, a voltage can be controllably applied to the cathode sides of the respective red LED lamps 103*a* or green LED lamps 103*b* in a desired one of the illuminant dots Hl–Hn by means of an external controller (not shown) to thereby selectively turn on and off the desired illuminant dot (s) Hl –Hn with different colors, so that a desired display can be achieved. In this instance, the turn-on/off or lighting drive system requires only an external lighting control wire and it may be either of a dynamic drive system or a static drive system.

The above-mentioned case frame member 3 is formed of polycarbonate, noryle or similar resin and at least the inner and outer surfaces of the light emitting surface side of the case frame member 3 are both provided as a light absorbing surface of a black or grey system. The case frame member 3 includes a visor 31 disposed on the top portion thereof and projecting in the forward direction, a receiving flange member 32 disposed on the bottom portion thereof and projecting in the forward direction, and a mounting plate 33 which is inclined such that the lower portion or the case frame member 3 is narrower. The visor 31 and receiving flange member 32 respectively include in their deep inner portions thereof stepped portions to receive the above-mentioned wired substrate 2. The mounting plate 33 is inclined at an angle $\theta$ with respect to a vertical surface (see FIG. 3). Therefore, if the case frame member 3 is mounted to the vertical surface, then the optical axes of the respective LED lamps 103*a*, 103*b* of each of the illuminant dots Hl-Hn are directed downward by the angle $\theta$ to thereby provide a matched directivity, so that the visibility from the practical view position, that is, the visibility from below can be improved. Preferably, the angle $\theta$ may be on the order of 5°-25°. Also, the case frame member 3, alternatively, may be constructed such that an adjustment bolt (not shown) or the like is provided therein and the mounting angle $\theta$ can be variably adjusted in the range of 0°-30° by use of the adjustment bolt. Here, the visor 31 is used to block the external light entering from above to thereby improve the visibility, and the length of the visor, 31 may be effectively in the range of a half at the height of the illuminant to the same height as the illuminant dot.

Figure 5:
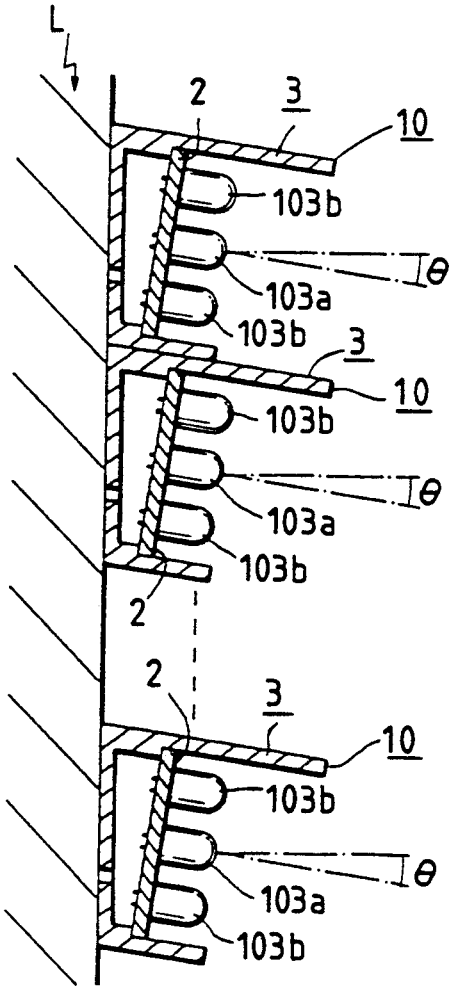
FIG. 5 is a schematic longitudinal section view of the present illuminant display device.

Referring to the practical use of the illuminant display device 10 according to the present invention, a large number of such illuminant devices 10 are arranged vertically and horizontally on the vertical wall L of a building and the like, for example, as shown in FIG. 5. In other words, if the illuminant display devices 10 are arranged in parallel in the vertical direction in the same number as the number of the illuminant dots H1, H2, . . . respectively then a display unit having a large screen with the illuminant dots H1, ... arranged vertically and horizontally in the same number in a matrix can be constructed with extreme easiness. Also, when mounted onto the vertical wall L, the respective illuminant display devices 10 are set in such a manner that the optical axes thereof are inclined at an angle $\theta$ downwardly from the horizontal. When compared with the conventional one in which the respective LED combined lamp devices 105 are mounted vertically and horizontally and are wired separately, the present invention can realize a great reduction in both the operation steps and the number of parts required. And, when the LED lamps 103*a*, 103*b* respectively having different illuminant colors of the illuminant dots H1, . . . are connected to a controller (not shown) composed of an external CPU and the like and are controlled or turned on and off according to the program of the controller, then desired characters, figures, symbols and the like can be lighted and displayed while the display colors thereof are varied. In this case, the lighting control can be performed in either dynamic or static drive system by means of selection of the external wiring and controller. Also, due to the fact that the mounting plate 33 of the case frame member 3 is inclined at the angle of $\theta$, the optical axes of the respective illuminant dots H1, . . . of the upper and lower respective illuminant display devices 10 are inclined by the angle $\theta$ downwardly from the horizontal so as to be substantially identical with an angle formed when the screen is viewed from below. This can enhance the visibility at a practical view position where the screen is viewed from below when the desired characters, symbols and the like are displayed, that is, this can improve both the directivity and visibility of the illuminant display device.

Further, for example, when mounting the respective illuminant display devices 10 to be arranged vertically in line onto the wall of the building, if the angles of mounting of the illuminant display devices 10 are adjusted and set by means of a spacer, an adjustment bolt or the like, then the illuminant display devices 10 in each vertical line can be set with ease in such a manner that the angles $\theta$ of the respective optical axes of the illuminant dots of the illuminant display devices 10 are different from one another. For example, if the illuminant display devices 10 are mounted in such a manner that the angle $\theta$ of the illuminant display devices 10 to be arranged in the uppermost line is set to be the largest and that the angle $\theta$ decreases as the lines descend, then the optical axes of the illuminant dots at the practical view position are allowed to coincide with one another with greater accuracy. In other words, the optical axes of each line of illuminant dots can be set in various ways according to the installation locations of the illuminant display devices 10.

Figure 6:
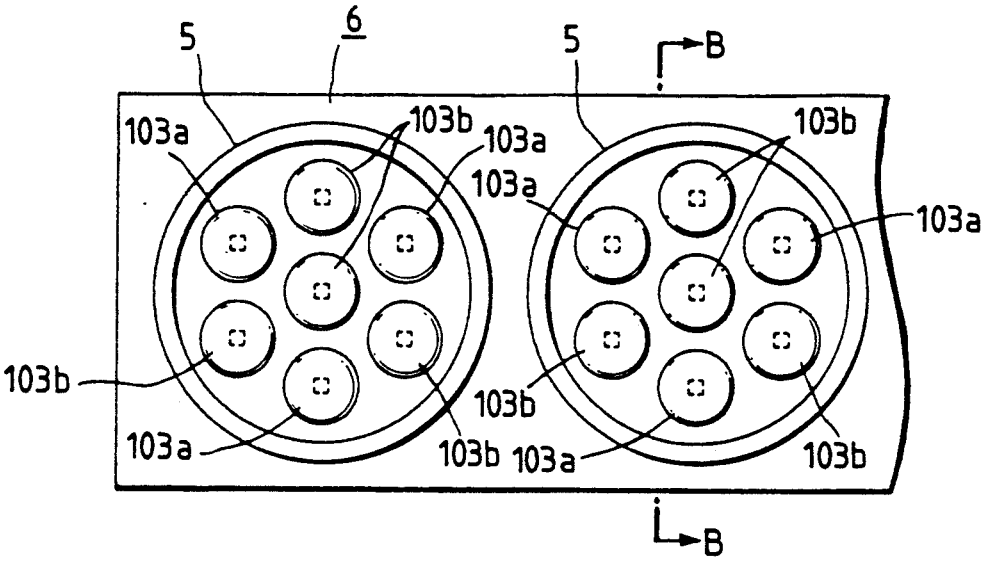
FIG. 6 is a partially enlarged front view of modification of an illuminant display device according to the present invention.
Figure 7:
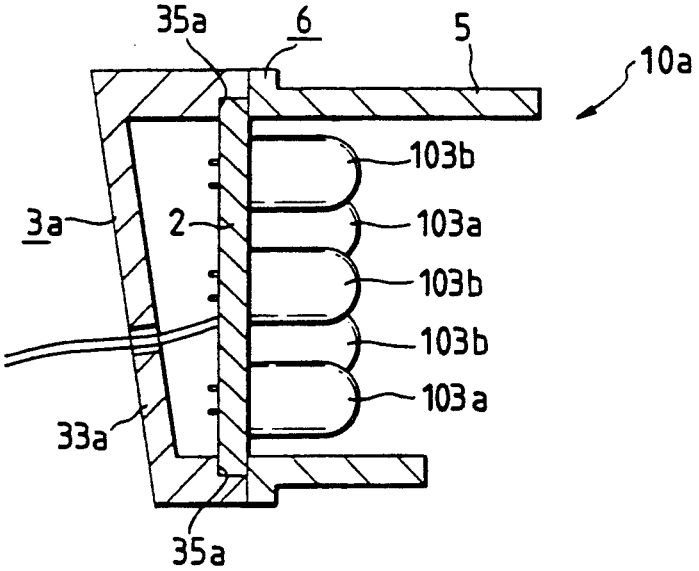
FIG. 7 is an enlarged partial section view taken along the line B—B in FIG. 6.

Referring now to FIG. 6 showing a modification of an illuminant display device 10 according to the present invention. In FIG. 7 is a schematic section view taken along the line B—B in FIG. 6. An illuminant display device 10*a* shown in these figures is characterized by the structure of a case frame member 3*a* and by the arrangement of respective LED lamps 103*a*, 103*b*. More specifically, three red LED lamps 103*a* and four green LED lamps 103*b* are concentrically arranged and disposed on a wired substrate 2 and a large number of substantially circular illuminant dots H1, . . . are provided in this manner. The illuminant display device 10*a* is also suitable for a large-sized dot having a dot pitch of the order of 15 mm to 150 mm. In this case, the number of the LED illuminant members 103*a*, 103*b* to be disposed in one illuminant dot H1, H2, . . . is of the order of 5-100. Also, the number of the illuminant dots to be arranged in a horizontal line is preferably of the order of 4-16. Further, of course, the wired substrate 2 to be stored and disposed in the case frame member 3, 3*a* may be divided into a plurality of sections.

The case frame member 3*a* includes, on the leading end face thereof, stepped portions 35*a* which are used to receive the wired substrate 2. The mounting plate 33*a* is inclined at an angle of $\theta$ similarly to the before-mentioned illuminant display device 10. A cover member 6 is mounted to the front surface of the mounting plate 33*a*. Integrally with the cover member 6, there is formed a substantially cylindrical hood cover 5 which is used to separate the respective illuminant dots H1, H2, . . . from one another, to prevent the lights of the dots from leaking to the mutually adjoining illuminant dots, and to block external light from above. It is effective that the length of the longest portion of the hood cover is in the range of a half of the diameter of the illuminant dot to the diameter of the illuminant dot.

The illuminant display device 10*a* constructed in this manner, similarly to the above-described illuminant display device 10, is vertically arranged in a plural number to thereby form a display unit having a large screen in which the respective illuminant dots H1, . . . are arranged vertically and horizontally in a matrix. In the illuminant display device 10*a*, the light leakage to the mutually adjoining illuminant dots H1, . . . can be prevented completely by the hood cover 5 and, therefore, the present illuminant display device can further improve the contrast when the respective illuminant dots H1, . . . are turned on and off.

Also, in the foregoing description, both of the above-mentioned illuminant display devices 10 and 10*a* are constructed respectively by mounting the LED lamps onto the wired substrate. However, this is not limitative. Alternatively, LED chips may be disposed and wired directly to a wired substrate and be sealed with resin members, and convex lens forming members may be put on their front faces respectively.

With the first embodiment, as can be clearly understood from the foregoing description, due to the fact that the illuminant dots each composed of a plurality of LEDs are arranged in line, for example, only by arranging a plurality of such illuminant display devices, the optical axes of the illuminant dots can be accurately set for each horizontal line to thereby be able to realize an excellent display matched to the view position. Further, it is also possible to simply construct an illuminant display unit having a large screen in which the respective illuminant dots are arranged vertically and horizontally in a matrix. When compared with a conventional illuminant display device in which a large number of LED lamp devices are respectively assembled vertically and horizontally to thereby provide a matrix display unit having a large screen, the present illuminant display device is greatly improved in its workability, manufacturing costs and the like.

Figure 8:
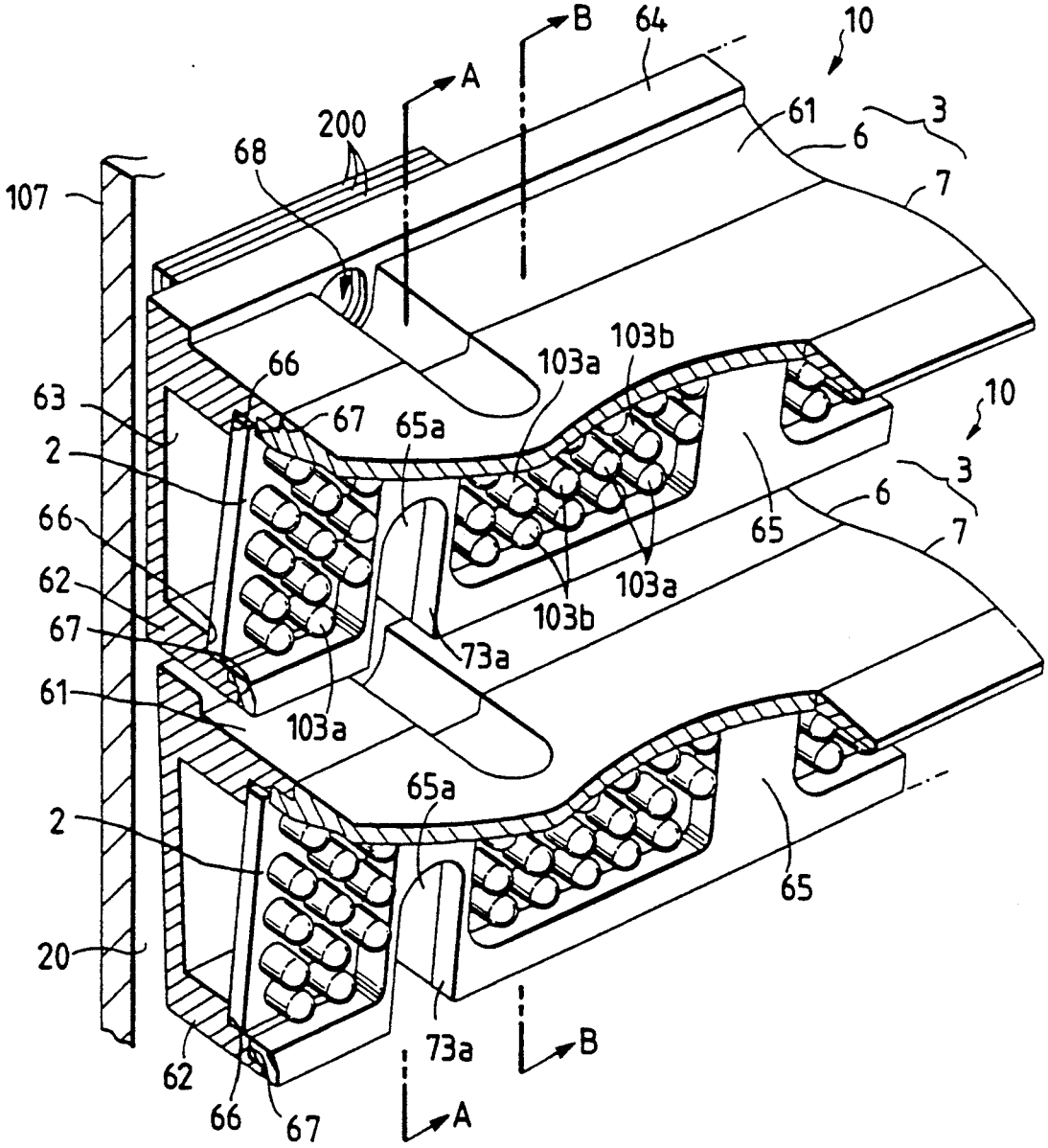
FIG. 8 is a schematic perspective view, broken in part, of a second embodiment of an illuminant display device according to the present invention.
Figure 9:
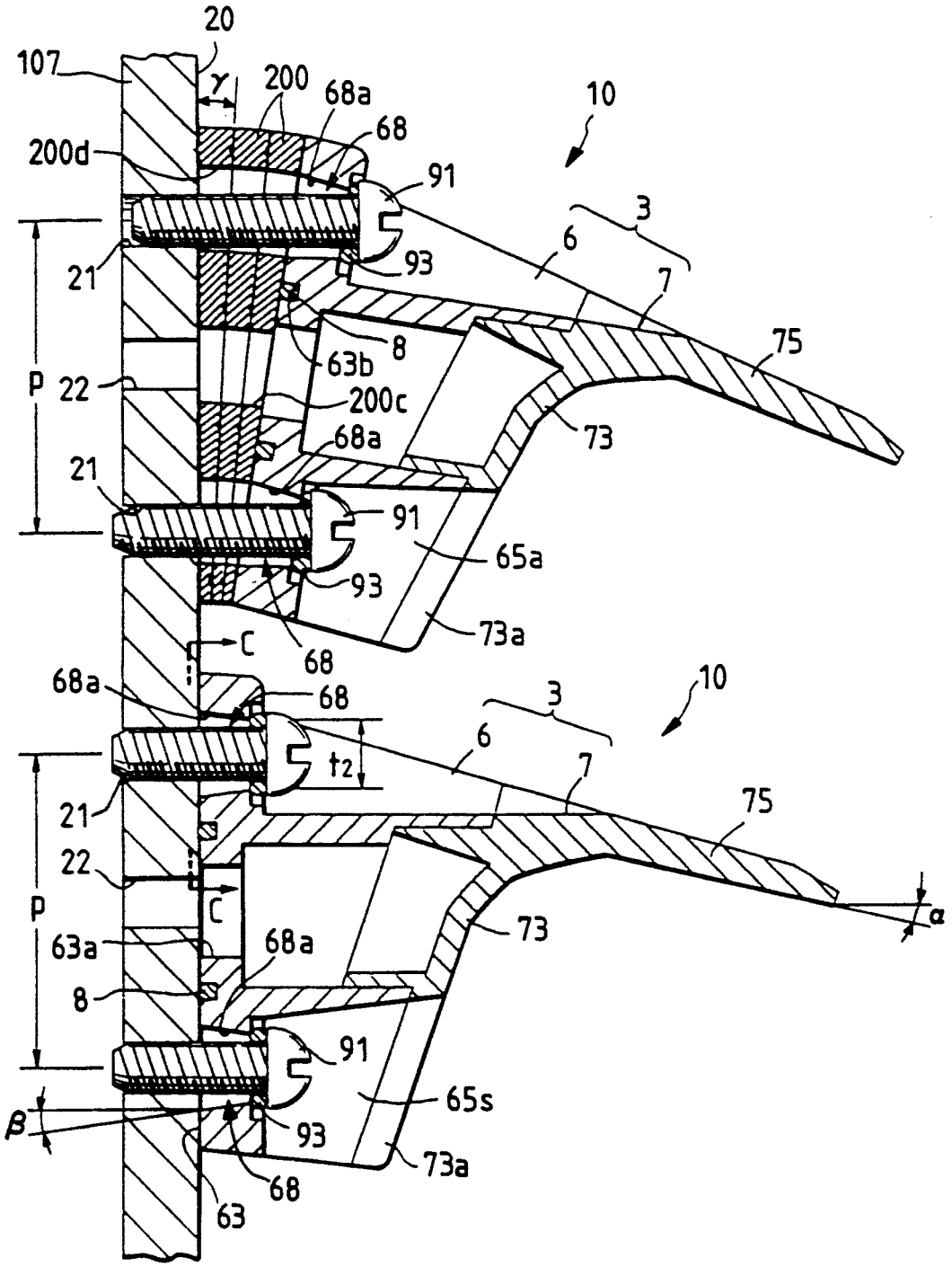
FIG. 9 is a schematic section view of the above embodiment, taken along the line A—A in FIG. 8.
Figure 10:
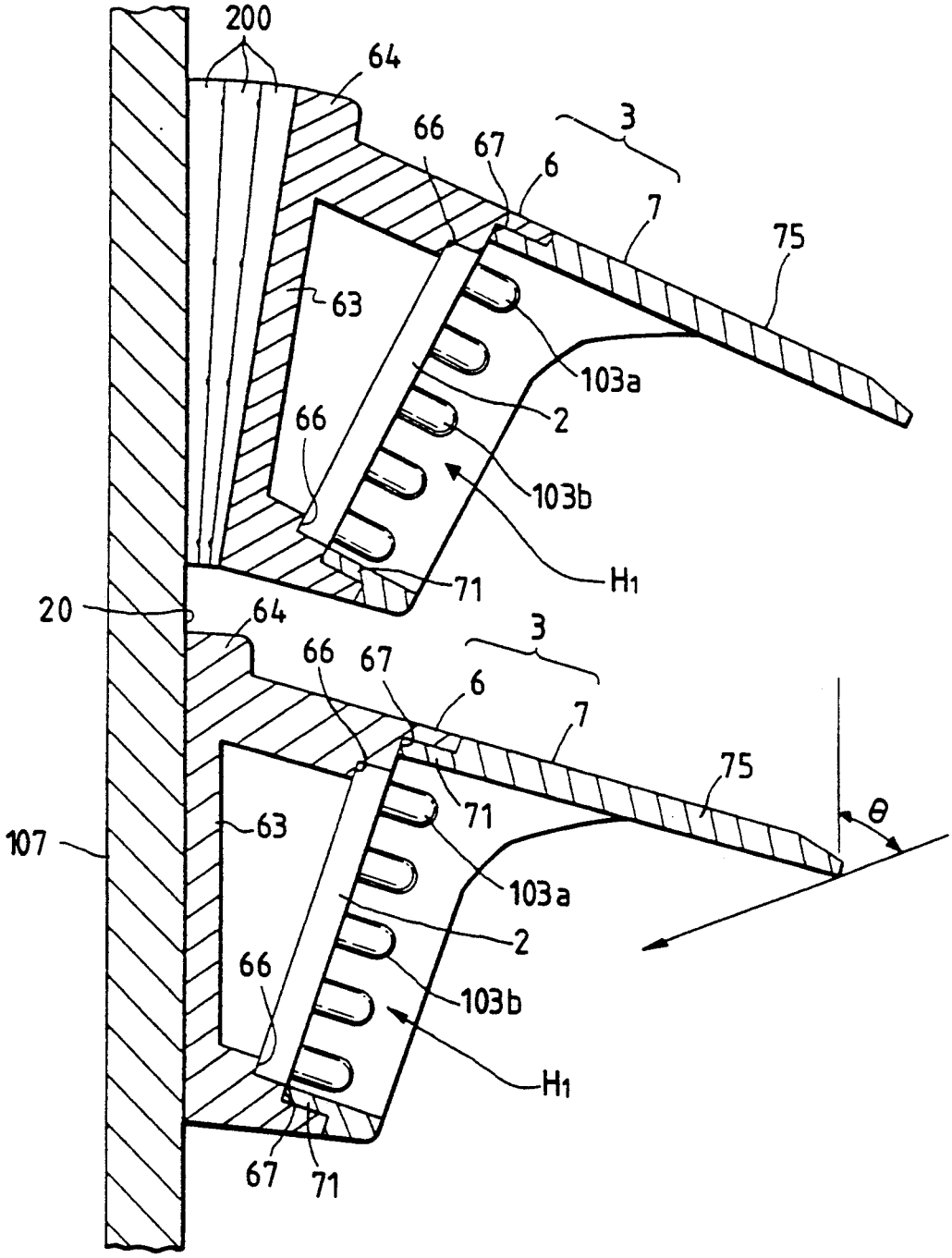
FIG. 10 is a schematic section view of the same embodiment, taken along the line B—B in FIG. 8.

FIG. 8, is a schematic perspective view, in partial section, of a second embodiment of an illuminant display device according to the present invention. FIG. 9 is a schematic section view taken along the line A—A in FIG. 8, and FIG. 10 is a schematic sectional view taken along the line B—B in FIG. 8. According to the present embodiment, in order to arrange a plurality of illuminant display devices 1 vertically and horizontally or laterally with respect to a box member 107 to be mounted to an outer wall or the like of a building so as to form a large screen, a spacer 200 is interposed between the illuminant display device 1 and the box member 107 to be mounted, whereby desired characters, symbols and the like formed by dots can be illuminantly displayed.

The above-mentioned illuminant display device 10 has a wired substrate 2 with a large number of LED lamps 103*a*, 103*b* wired and mounted thereto. The LED lamps 103*a*, 103*b* are respectively formed of LED illuminant elements having different illuminant colors and sealed with resin members. A case frame member 3 has a plurality of such wired substrates 2 disposed therein in such a manner that they are arranged horizontally or laterally in line. The case frame member 3 includes a mounting frame 6 to be contacted and fixed to the box member 107, and a hood frame 7 to be mounted to the front surface of the mounting frame 6. In this embodiment, after the wired substrates 2 are assembled into the mounting frame 6, the hood frame 7 is mounted, thereby providing the illuminant display device 10 with a plurality of illuminant dots H1 arranged horizontally or laterally.

As is similar to the first embodiment, the before-mentioned conventional LED lamps 103*a*, 103*b* can be used. For example, a plurality of red LED lamps 103*a* and green LED lamps 103*b* are conveniently disposed in and wired to the wired substrate 2 to thereby form one illuminant dot H1. In this case, the arrangement and combination as well as the number of the LED lamps 103*a*, 103*b* forming one illuminant dot H1 depends on the size of the wired substrate 2 to be determined by the size and the like of the illuminant display device 10. In this second embodiment, the wired substrate 2 is disposed in the mounting frame 6 in such a manner that it is inclined downwardly at an angle of 16° (therefore, the central angle of the illuminant optical axis is the same angle) with respect to the back surface (that is, the surface to be mounted) of the mounting frame 6.

The wired substrate 2, to which a plurality of LED lamps 103*a*, 103*b* are to be mounted and wired, is a print substrate which is formed mainly of glass epoxy resin, paper phenol, or the like. After the above-mentioned respective LED lamps 103*a*, 103*b* are mounted thereto, the wired substrate 2 is allowed to make a circuit which is able to turn on and off the lamps for each illuminant color. In other words, as shown in FIG. 4, the LED lamps 103*a*, 103*b* of the respective illuminant dots H1 which emit the same color lights are respectively connected in series. At the same time, for example, while the anode sides thereof (cathode sides thereof) are wired in common to thereby provide a common terminal and the cathode sides of the respective LED lamps 103*a*, 103*b* of the respective illuminant dots H1 are used as a terminal, the wired substrate 2 can be connected to an external circuit substrate (not shown) which is used to control the turn on-and-off. When the anode sides (cathode sides) of the respective LED lamps 103*a*, 103*b* are all internally connected to the common terminal, then the number of wires to be connected to external circuits can be reduced and, with the anode sides thereof used in common as a common terminal, a voltage is controllably applied to the cathode sides of the respective red LED lamps 103*a* or green LED lamps 103*b* of a desired illuminant dots H1 by means of an external controller (not shown) to thereby selectively turn on and off the desired illuminant dots H1 while varying the illuminant colors thereof, that is, to be able to perform a lighting control operation. In this case, the lighting drive system requires only wiring to be connected to the external lighting control system which may be either of dynamic static system.

The above-mentioned case frame member 3 comprising the mounting frame 6 and hood frame 7 is formed of a resin such as polycarbonate, noryle or the like. The back surface 63 of the mounting frame 6 includes in the top and bottom portions thereof an upper flange portion 61 and a lower flange portion 62 extending forwardly and downwardly therefrom in such a manner that the upper flange portion 61 is longer than the lower flange portion 62 and the respective angles $\theta$ thereof are about 16° so as to be matched to the central angle of the optical axes. A raised stepped portion 64 is provided on the back surface (the surface to be mounted) of the upper flange portion 61. In the respective front portions of the upper and lower flange portions 61 and 62, there are formed recessed stepped portions 66 arranged horizontally or laterally in line, which are used to store a plurality of the above-mentioned wired substrates 4 separated from one another by partition members 65 and arranged horizontally or laterally in line. The respective front portions of the upper and lower flange portions 61 and 62 further include engaging stepped portions 67 which are used for integral engagement of the rear edge portion of the hood frame 7. Also, in the back surface 63 of the mounting frame 6 which serves as the surface to be mounted, there is formed an insertion opening 63*a* through which is guided a cable (not shown) to be connected to an external driving circuit substrate which controls or turns on and off the respective LED lamps 103*a*, 103*b* which are wired to and arranged in the wired substrate 2. The cable (not shown) is guided out through the insertion opening 63*a* into the box member 107. Further, there is recessed an insertion groove 63*b* for a waterproof packing 8 such as an O ring and the like which is used to prevent water and the like from entering the interior of the box member to be mounted 2 and the interior of the illuminant display device 1 from the insertion opening 63*a* when the mounting frame 6 is mounted to the box member 107.

The partition member 65 for separating the respective illuminant dots H1, as shown in FIG. 8, includes at least two right and left portions which are opened substantially in the lower half sections thereof, respectively, thereby providing a partition means 65*a*. In the backmost portion of the partition means 65*a*, there is formed a stop member insertion hole 68 (see FIG. 9). The stop member insertion hole 68 (see FIG. 9), as shown by its plan view in FIG. 15, has an elongated hole shape with the opening portion thereof slightly longer in the vertical direction thereof. And, the stop member insertion hole 68 also includes tapered surfaces 68*a* each widening toward the back end tapered surfaces 68*a* each widening toward the back end thereof at an angle $\beta$ of 12°. If the stop member insertion hole 68 of such structure is formed, then even when the mounting frame 6 is inclined in the range of ±12°, there can be provided a clearance in the vertical direction with respect to the diameter of a stop member 91 such as a screw and the like, whereby the stop member 91 can be inserted through the stop member insertion hole 68 in such a manner that the position of the stop member 91 is only slightly varied in the vertical direction thereof. And another stop member insertion hole 68 is similarly formed in the raised stepped portion 64 (see FIG. 8) corresponding to the position of the partition member 65 as well. In order to facilitate the insertion of the stop member 91, there is formed a substantially semi-circular recess in the upper flange portion 61 including the raised stepped portion 64.

The above-mentioned hood frame 7 to be mounted in front of the mounting frame 6 includes in the rear edge portion thereof, engaging stepped portions 71 respectively to be engaged with the engaging stepped portion 67 provided in the front opening of the mounting frame 6 (see FIG. 10). Also, raised stepped portions 72 are provided respectively to be engaged with the recessed stepped portions 66 for storing the wired substrate 2 in such a manner that they are arranged in line horizontally or laterally, and a hood partition member 73 is located so as to correspond to the above-mentioned partition member 65, and a hood partition means 73*a* which is opened in the lower portion thereof is provided so as to correspond to the partition means 65*a* formed in the stop member insertion hole 68.

The hood frame 7 further includes a visor 75 which extends in the extension direction of the upper flange portion 61 of ,the above-mentioned mounting frame 6. The visor 75 block the external light coming from above to thereby improve the visibility of the respective illuminant dots H1 when the respective LED lamps 103*a*, 103*b* are turned on. The length of the visor 75, as shown in FIG. 10, is set in such a manner that the incident interception angle $\theta$ of the sunlight is of the order of 50°-75° with respect to the illuminant display device 10 while it is inclined.

The partition member 65 of the mounting frame 6 and the hood partition member 73 of the hood frame 7, both of which have already been described above, separate the illuminant dots H1 in a horizontal and lateral line, the illuminant dots H1 being formed of a large number of LED lamps 103*a*, 103*b* wired to and disposed on the wired substrate 2 and also improves mounted in the respective recessed stepped portions 66 formed in the mounting frame 6. This configuration prevents the lights of the adjoining illuminant dots H1 from leaking into one another when the respective illuminant dots H1 are turned on, and also improves the rigidity of the case frame member 3 itself. And, in the illustrated embodiment, as the positions where the stop member insertion holes 68 for mounting the illuminant display device 10 to the box member 107 are formed, there are formed the partition means 65*a* and 73*a* which are opened in the lower portion thereof.

The mounting frame 6 and hood frame 7 can be connected together into an integral unit by bonding the engaging stepped portion 67 of the mounting frame 6 and the engaging stepped portion 71 of the hood frame 7 with an adhesive or the like, or can be connected and fixed integrally by means of stop members (not shown) or the like to thereby provide case frame member 3. Also, at least the portions of the mounting frame 6 and hood frame 7 other than the illuminant dots H1 may be preferably adapted to have a black system or a grey system of light absorbing surface so as to provide good contrast when the illuminant dots H1 are turned on or off.

Before the box member 2 is mounted onto the wall or the like of a building, a plurality of illuminant display devices 1 are arranged and fixed vertically in line and there are mounted within the box member 107 a drive circuit and a controller (neither of which are shown) which are used to control the voltage to be applied when the respective illuminant dots H1 are turned on or off. As shown in FIG. 9, the box member 107 includes a mounting surface 20 with which the back surface 63 of the mounting frame 6 of each of the illuminant display devices 1 is to be contacted. In the mounting surface 20, there are formed threaded holes 21, by tapping or the like, in such a manner that each of the threaded holes 21 corresponds to each of the stop member insertion holes 68, and a pitch p between the threaded holes 21 in each of the illuminant display devices 10 is set to be constant. Also, between the threaded holes 21 in the box member 2, there is also opened up a cable insertion opening 22 which corresponds in position to the cable insertion opening 63*a*.

Figure 11:
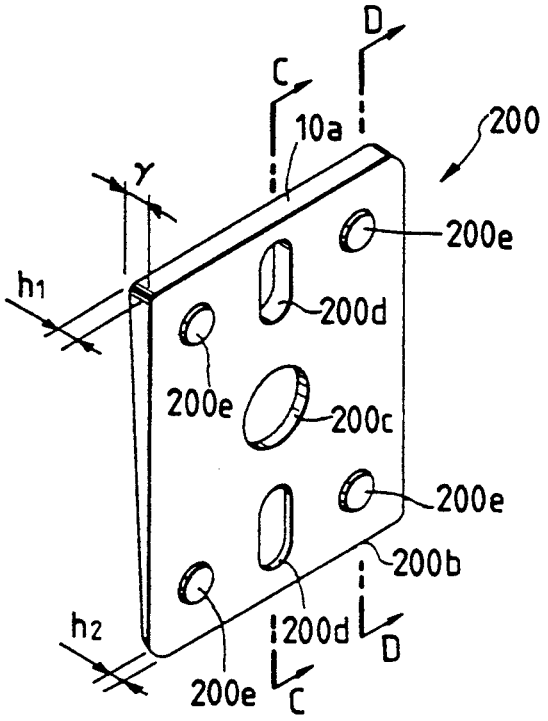
FIG. 11 is a schematic perspective view of the front surface side of a spacer employed in the second embodiment.
Figure 13:
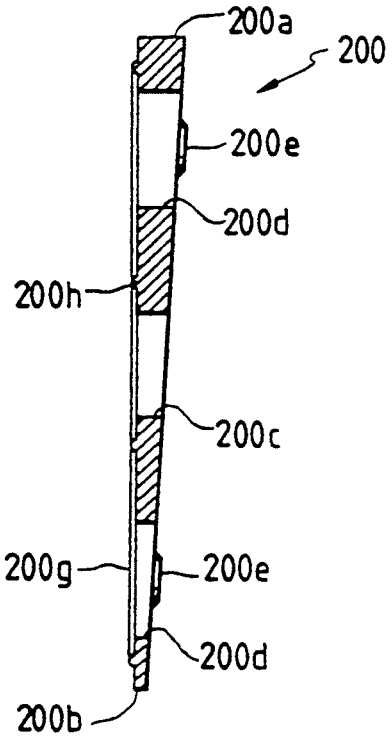
FIG. 13 is a schematic section view of the spacer of FIG. 11, taken along the line C—C in FIG. 11.
Figure 12:
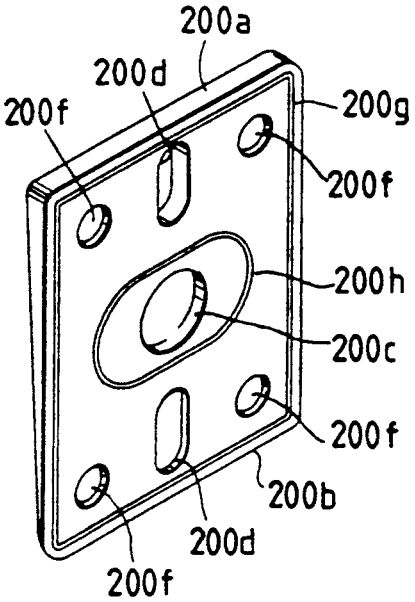
FIG. 12 is a schematic perspective view of the back surface side of the spacer employed in the second embodiment.
Figure 14:
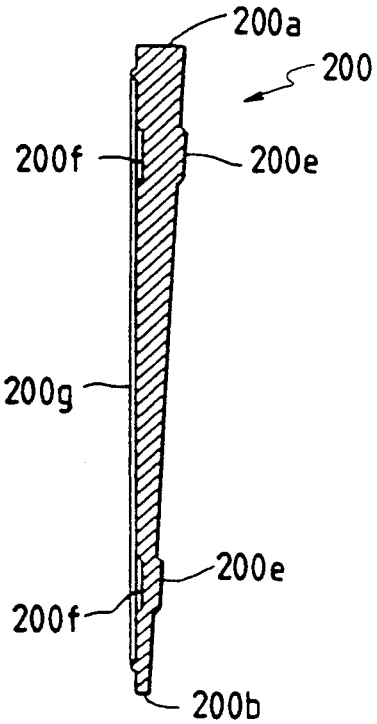
FIG. 14 is a schematic section view of the spacer of FIG. 11, taken along the line D—D in FIG. 11.

The spacer 200 to be interposed between the illuminant display device 10 and the box member 107 is an elastic product formed of silicone rubber or the like and is positioned at a position where the stop member insertion hole 68 of the mounting frame 6 is formed. As shown in FIGS. 11 to 14, the spacer 200 is constructed such that the width h1 of its upper edge portion 200*a* is greater than the width h2 of its lower edge portion 200*b* and also that the longitudinal section of the spacer 200 is a substantially wedge-like shape the thickness of which increases at an angle $\gamma$ of about 3° toward the upper edge portion. In the substantially central portion of the spacer 200, as shown in FIGS. 11 and 14, there is formed a cable insertion hole 200*c* such that it corresponds to the cable insertion opening 63*a* of the back surface 63 of the mounting frame 6 and it is slightly smaller in diameter than the insertion opening 63*a*. And above and below the cable insertion hole 200*c*, there are elongated holes 200*d* which respectively correspond to the stop member insertion holes 68 and are longer in the vertical direction thereof.

In addition, the spacer 200 includes, adjacently in the four corners of its front surface, projections 200*e* which are circular and are used to position the spacer 200 itself and also includes, adjacently in the four corners of its back surface, circular recesses 200*f* into which the projections 200*e* are to be fitted respectively. In the neighborhood of the back surface peripheral edge and cable insertion hole 200*c*, there are provided ribs 200*g*, 200*h* which respectively project out therefrom and have a substantially semicircular section. As shown in FIG. 9, if three pieces of such spacers 200 are used and the respective projections 200*e* provided on the front surfaces of the respective spacers 200 are fitted into the respective recesses 200*f* formed on the back surface thereof, then there can be provided a wedge shaped spacer which increases in thickness from the lower edge portion 200*b* toward the upper edge portion 200*a* at an angle of 9°. If the respective spacers 200 are superimposed on another in this manner, then the respective ribs 200*g* and 200*h* serve as water-proof packings which prevent water from entering the wired substrates 2 of the illuminant display device 10 through the cable insertion holes 200*c*, thereby eliminating the possibility that the water may have ill effects on the wiring patterns of the wired substrate 2 and the like.

In the illustrated embodiment, the spacer 200 is the elastic rubber member formed of silicone rubber or the like but it may be formed of a resin. However, when the waterproof effects between the respective illuminant display devices 10 and spacers 200, between the respective spacers 200, and between the spacers 200 and box member 107 are taken into consideration, the spacer 200 may preferably be the elastic rubber member formed of silicone rubber or the like.

Referring in brief to the mounting structure of the present embodiment for mounting the above-mentioned illuminant display device 10 to the box member 107 in such an inclined state that three spacers 200 are stacked on one another, as shown in FIG. 9, the respective cable insertion holes 200*c* of the three spacers 200 are positioned so as to correspond to the holes 22 respectively formed in the box member 107. The stop members 91 are respectively inserted through the stop member insertion holes 68 formed in the mounting frame 6 constituting the case frame member 5 of the illuminant display device 10 via elastic packings 93 or the like formed of silicone rubber or the like and are further threadedly engaged at right angles with the corresponding threaded holes 21, in which the illuminant display device 10 is mounted inclinedly to the box member 107 at an angle of about 25°, that is, the sum total of the angle $\alpha$ of 16° of the mounting frame 6 itself for the illuminant display device 10 and the angle of 9° formed by the three wedge-shaped spacers 200. According to this structure, due to the fact that the stop member insertion hole 68 of the mounting frame 6 through which the stop member 91 is inserted has a tapered surface 68*a* widening toward the back end thereof at an angle of about 12°, the stop member 91 can be threadedly engaged at right angles with the threaded hole 21 of the box member 107 through the cable insertion hole 200*c* of the spacer 200 without being contacted with the tapered surface 68*a* of the stop member insertion hole 68. In this case, if one spacer 200 is interposed between the illuminant display device 10 and box member 107, then the illuminant display device 10 is mounted to the box member 107 at an angle of 19° with respect to the box member 107; if two spacers 200 are interposed, then the illuminant display device 10 is mounted to the box member 107 at an angle of 22°; and the number of the spacers 10 to be interposed can be set up to 4. In any case, the illuminant display device 10 can be mounted to the box member 107 in such a manner that its mounting angle can be adjusted by adding the angle (s) of the wedge-shaped spacer (s) 200 to be interposed between the illuminant display device 10 and the box member 107 to the original inclination angle of the illuminant display device 10 in a range of the angle of the tapered surface 68*a* of the stop member insertion hole 68 in the mounting frame 6; and the stop member 91 can also be threadedly mounted at right angles directly or only by interposing the spacer(s) 200 to change the mounting angle of the illuminant display device 10, without changing the pitch p between the threaded holes 21 to be formed in the box member to be mounted.

On the other hand, if the spacer(s) 200 is (are) turned upside down and thus the spacer(s) 200 is (are) similarly disposed with the wider upper edge portion 200*a* facing downwardly, then the illuminant display device 10 is turned upwardly by 3° when one spacer 200 is used, and the illuminant display device 10 is turned upwardly by 9° when three spacers 200 are used, whereby the illuminant display device 10 is actually mounted to the box member 107 at an angle of 7° with respect to the box member 107. In this case as well, the stop member 91 to be inserted through the stop member insertion hole 68 of the mounting frame 6 and be threadedly engaged with the threaded hole 21 of the box member 107 can be threadedly engaged into the threaded hole 21 of the mounting frame 6 at right angles without being contacted with the tapered surface 68*a* of the stop member insertion hole 68, and thus the illuminant display device 10 can be mounted to the box member 107 at an inclination angle smaller than the original inclination angle $\alpha$ of the illuminant display device 10.

In this manner, if the above-mentioned structure is employed in which the wired substrate 2 with the LED lamps 103*a*, 103*b* wired and mounted thereto and forming the illuminant dot H1 is separated by the partition member 65 of the mounting frame 6 of the case frame member 5 and by the partition member 73 of the hood frame 7 of the case frame member 5 to thereby form a horizontally and laterally lined illuminant dots H1 and the illuminant display device 10 with the thus formed illuminant dots H1 is mounted inclinedly to the box member 107 at an angle to be formed by interposing one or more (up to four) spacers 200 between them, then a large-sized display unit can be constructed very simply in which a plurality of illuminant display devices 10 are arranged vertically and horizontally on the mounting surface 20 of the box member 107 and a large number of illuminant dots H1 of the respective illuminant display devices 10 are arranged vertically and horizontally at regular intervals in a matrix.

Figure 15:
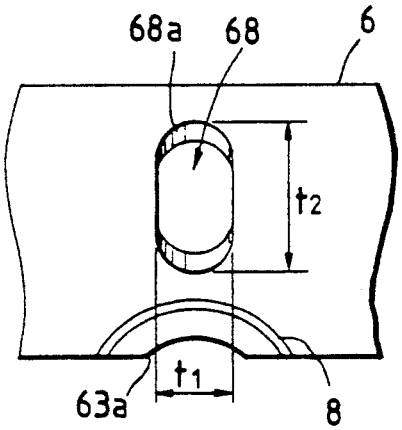
FIG. 15 is an enlarged view of main portions of a stop member insertion hole, taken along the line C—C in FIG. 9.

According to the present embodiment, due to the fact that the stop member insertion hole 68 is formed as an elongated opening having a clearance in the vertical direction thereof and also that the insertion hole 68 is arranged so as to include the tapered surfaces 68*a* respectively in the upward and downward direction thereof, each having a tapered angle of ±12°, when the illuminant display device 10 is mounted without the use of spacers 200 as well as when the illuminant display device 10 is mounted utilizing a plurality of spacers, the pitch p between the corresponding threaded holes 21 formed in the box member 107 can be set constant by means of the elongated opening having the above clearance in the vertical direction thereof. For this reason, even when the mounting angle of the illuminant display device 10 is varied, due to the provision of the vertically tapered surfaces 68*a* of the elongated hole having a clearance in the vertical direction with respect to the stop member insertion hole 68 of the illuminant display device 10, within the range of the vertical clearance and tapered angles, the stop member 91 can be threadedly engaged at right angles with the mounting surface 20 of the box member 107 without changing the pitch p between the threaded holes 21 in the box member 107, and the illuminant display devices 10 arranged horizontally and laterally in line can be mounted to box member 107 very simply in such a manner that the mounting angles of the illuminant display devices 10, that is, the inclinations of the optical axes of a plurality of illuminant dots H1 arranged horizontally and laterally in line are all identical with one another. In this case, when the mounting screw is an M4 screw and the range of the mounting angles is within ±12°, then the concrete design dimensions of the stop member insertion hole 68 are as shown in FIGS. 9 and 15, that is, the vertically elongated opening t1×t2 is 4.5×7.0 mm and the vertically tapered angle $\beta$ of the inner surface thereof is 12° as described previously.

Figure 16:
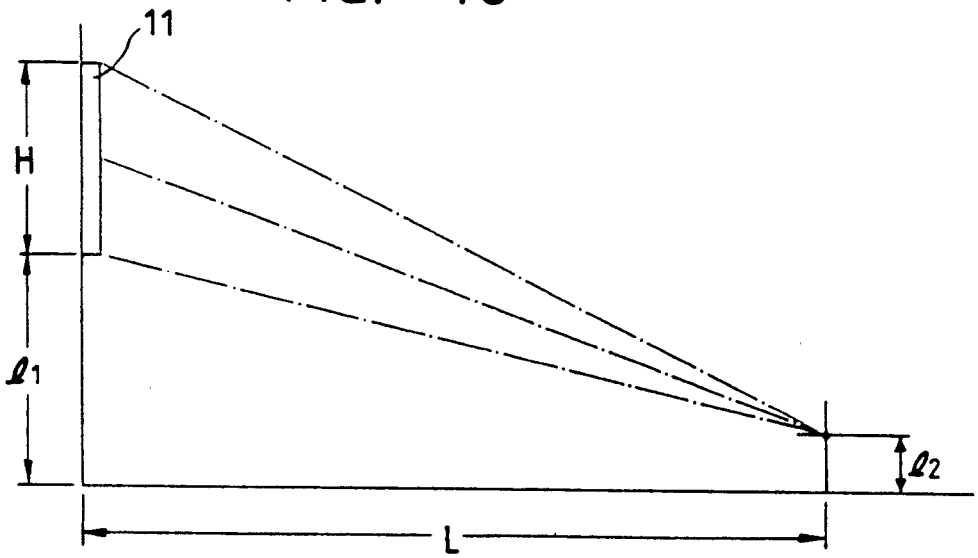
FIG. 16 is an explanatory view of installation of a display unit employing the illuminant display device.

Referring to the actual use of the illuminant display device 10, in most cases, a plurality of such illuminant display devices 10 are disposed on the box member 107 to construct a large screen and the box member 107 is then installed onto the high wall of a building or the like. For example, as shown in FIG. 16, a plurality of illuminant display devices 10 are arranged vertically and horizontally to thereby construct a display unit 11 with a big screen having a vertical height H of about 5 m and the display unit 11 is then installed on the vertical wall of the building or the like having a height $l_1$ of 6 m. If the display unit 11 is viewed from a practical view position, that is, at the height of one's eyes of about 21.5 m in a place spaced by a distance L of 20 m apart from the position where the display unit 11 is mounted, then the angles of view obtained when the upper edge (upper) position, central position and lower edge position of the large-sized display unit 11 are respectively viewed up from the practical view position are of the order of 25°, 16° and 13°, respectively. Therefore, in this case, in order to construct the large-sized display unit 11 in which the illuminant display devices 10 are respectively inclined at their desired view angles, the respective illuminant display devices 10 arranged in horizontal lines to be disposed in the neighborhood of the upper edge portion of the large-sized display unit 11 may be mounted to the box member 107 in such a manner that three spacers 200 are interposed between them to thereby incline the illuminant display devices 10 at an angle of about 25° with respect to the box member 107, the illuminant display devices 10 to be located in the central portion of the display unit 11 may be mounted as they are with no spacer 200 interposed therebetween, and the illuminant display devices 10 to be located in the lower edge portion of the display unit 11 may be mounted by interposing one spacer 200 which is turned upside down. In other words, the respective illuminant display device 10 can be mounted at their desired angles of inclination with respect to the box member 107 in such a manner that the installation place and height of the illuminant display devices 10 and the optical axes of the respective illuminant dots H1 of the large-sized display unit 11 at the practical view position, which is dependent on the visible position and distance can be matched substantially to the desired view position.

If the angles of inclination of the respective illuminant display devices 10 of the large-sized display unit 11 can be adjusted at the practical view position by insertion of one or more spacers 200 to thereby match the optical axes of the respective illuminant dots H1 arranged in every horizontal lines to the practical view position with ease, then it is possible to enhance the directivity and visibility obtained when displaying illuminantly characters, symbols and the like formed by dots to be displayed by the respective illuminant dots H1 which emit lights when controlled by an external controller (not shown). Also, the leakage of the lights between the adjoining illuminant dots H1 can be prevented by the partition members 65 and hood partition members 73 of the mounting frame 6 and hood frame 7 of the case frame member 5 to thereby improve the contrast when the illuminant dots H1 are turned on and off, so that a highly versatile, large-sized display unit can be constructed with ease.

In the illustrated embodiment of the illuminant display device 10, the mounting frame 6 and hood frame 7 are used as separate members to construct the case frame member 5. However, alternatively, for example, the mounting frame 6 and hood frame 7 may be originally formed as an integral member, the integral member may be opened on the back surface side thereof, the wired substrate 2 may be mounted to the integral member from back, and a back cover may be put onto the back surface to thereby make up an illuminant display device of a different structure.

Also, in the illustrated embodiment, the LED lamps 103*a*, 103*b* are wired and mounted to the wired substrate 2 of the illuminant display device 10. However, alternatively, the illuminant display device 10 may be constructed by mounting and wiring LED illuminant elements directly to the wired substrate, sealing the LED illuminant elements with resin members, and then putting convex lens forming members respectively onto the front surfaces thereof. And, the arranging patterns of the LED lamps 103*a*, 103*b* can also be changed conveniently according to the designs. Practically, the number of the LED illuminant members 103*a*, 103*b* to be arranged in one illuminant dot H1 may be preferably on the order of 5–100, the number of dots of the illuminant dot H1 formed in one horizontal line in the illuminant display device 1 may be preferably on the order of 4–16, and the dot pitch between the respective illuminant dots H1 may be preferably on the order of 15 mm–150 mm, which means the illuminant dots H1 are large.

Further, the angle of inclination of the tapered surface 68*a* of the stop member insertion hole 68 in the mounting frame 6 and the angle $\gamma$ of the wedge-shaped spacer 200 are not limited to those described in the illustrated embodiment but, if both angles are conveniently changed, of course, then the adjustment range of the mounting angles of the illuminant display device 10 can be widened. Practically, the adjustment range of the order of ±12° or less suffices for this purpose. And the shape of the stop member insertion hole 68 is not limited to the tapered surface 68*a* which widens toward the back end thereof, but, alternatively, in order that the stop member 91 can be screwed at right angles into the box member 107 to thereby mount the illuminant display device 10 to the box member 107, the stop member insertion hole 68 may be constructed such that the upper and lower surfaces thereof are respectively inclined stepwise and widen toward the back end thereof. That is, the shape of the inner surface of the stop member insertion hole widening toward the back end thereof is not limited to specific ones.

According to the second embodiment of the present invention, there is shown a mounting structure in which the stop member insertion holes 68 for insertion of the stop members 91 are formed in four positions, that is, in the partition means 65*a*, 73*a* between the right and left illuminant dots H1 and in the raised stepped portions 64 located above them. However, alternatively, another mounting structure (not shown) may be employed in which the illuminant display device 10 may be mounted to the box member 107 in such a manner that the stop member insertion holes are formed only substantially in the central portions of at least two right and left sections of the above-mentioned partition means 65*a*, 73*a*. In this case, the stop member insertion hole may not be formed as a vertically elongated hole but may be formed such that it includes tapered surfaces in the upper and lower surfaces thereof. That is, the positions where the stop member insertion holes are formed are not limited to specific ones, provided that they do not impair the visibility of the characters, symbols and the like when the respective illuminant dots H1 are turned on.

In the second embodiment of the invention, by inserting the stop members 91 respectively through the stop member insertion holes 68 formed in the four positions of the illuminant display device 10 to thereby mount the illuminant display device 10 to the box member 107, a large number of illuminant dots H1 can be formed in a horizontal line.

Figure 17:
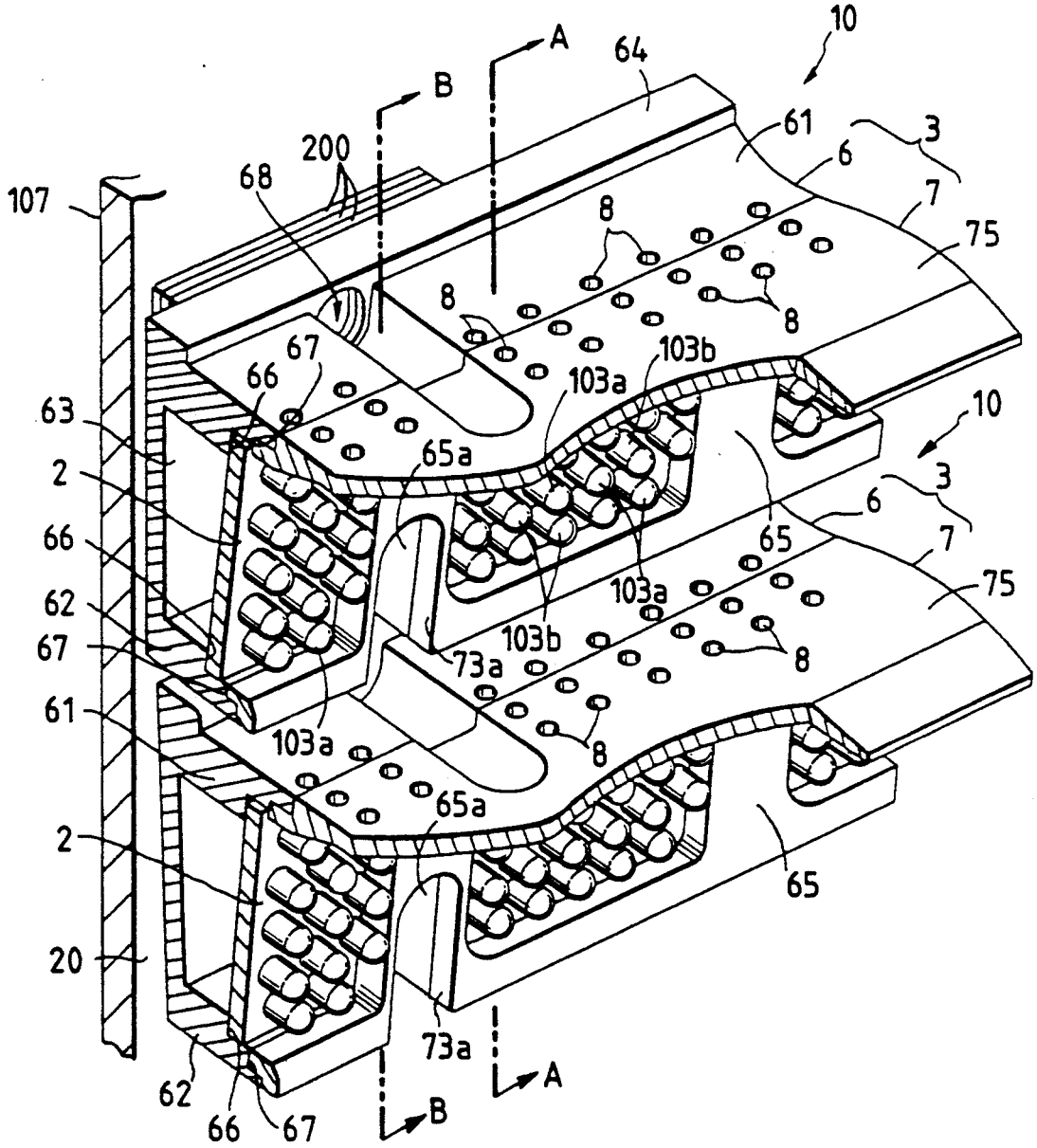
FIG. 17 is a schematic perspective view, broken in part, of a third embodiment of an illuminant display device according to the present invention.
Figure 18:
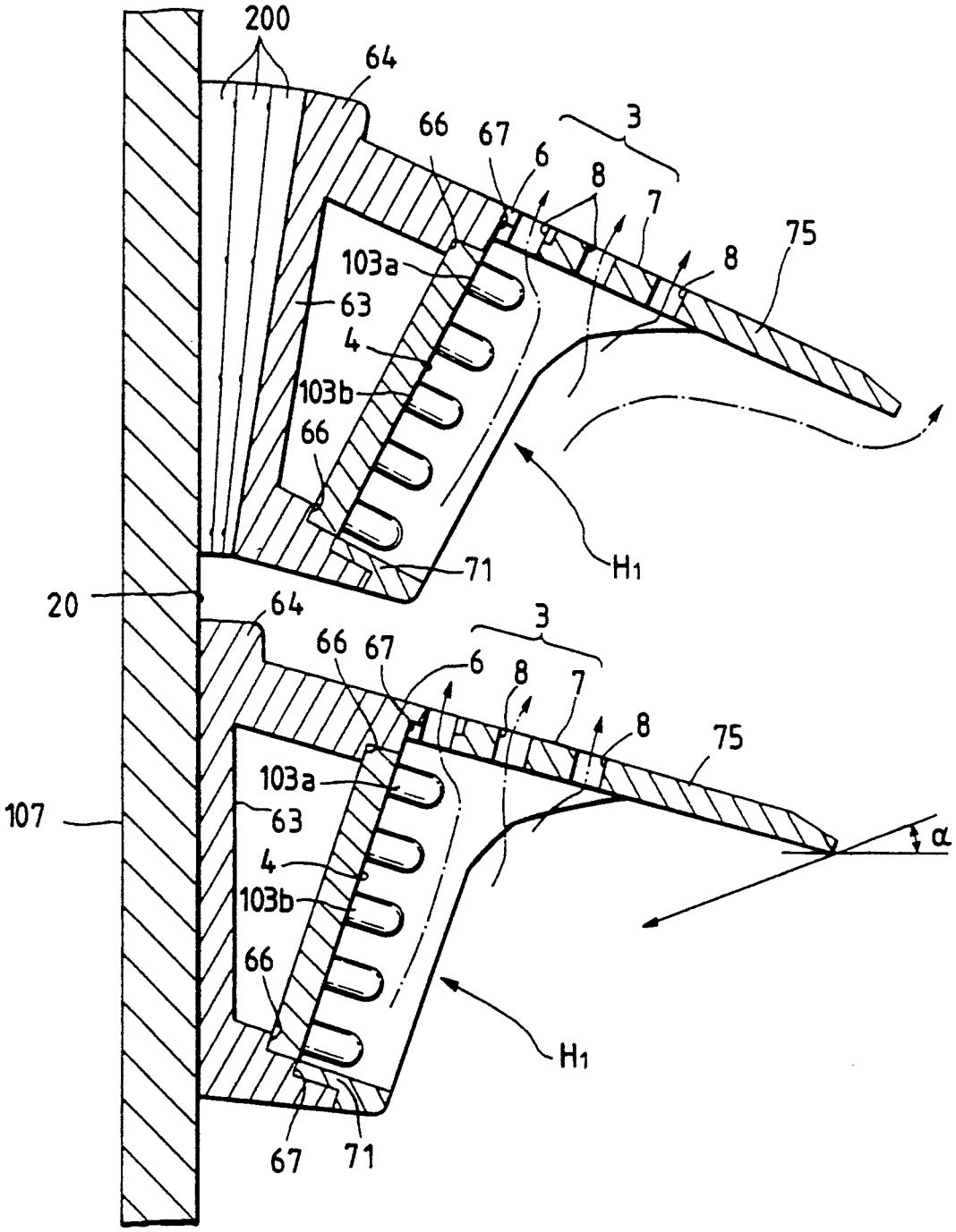
FIG. 18 is a schematic section view taken along the line A—A in FIG. 17.
Figure 19:
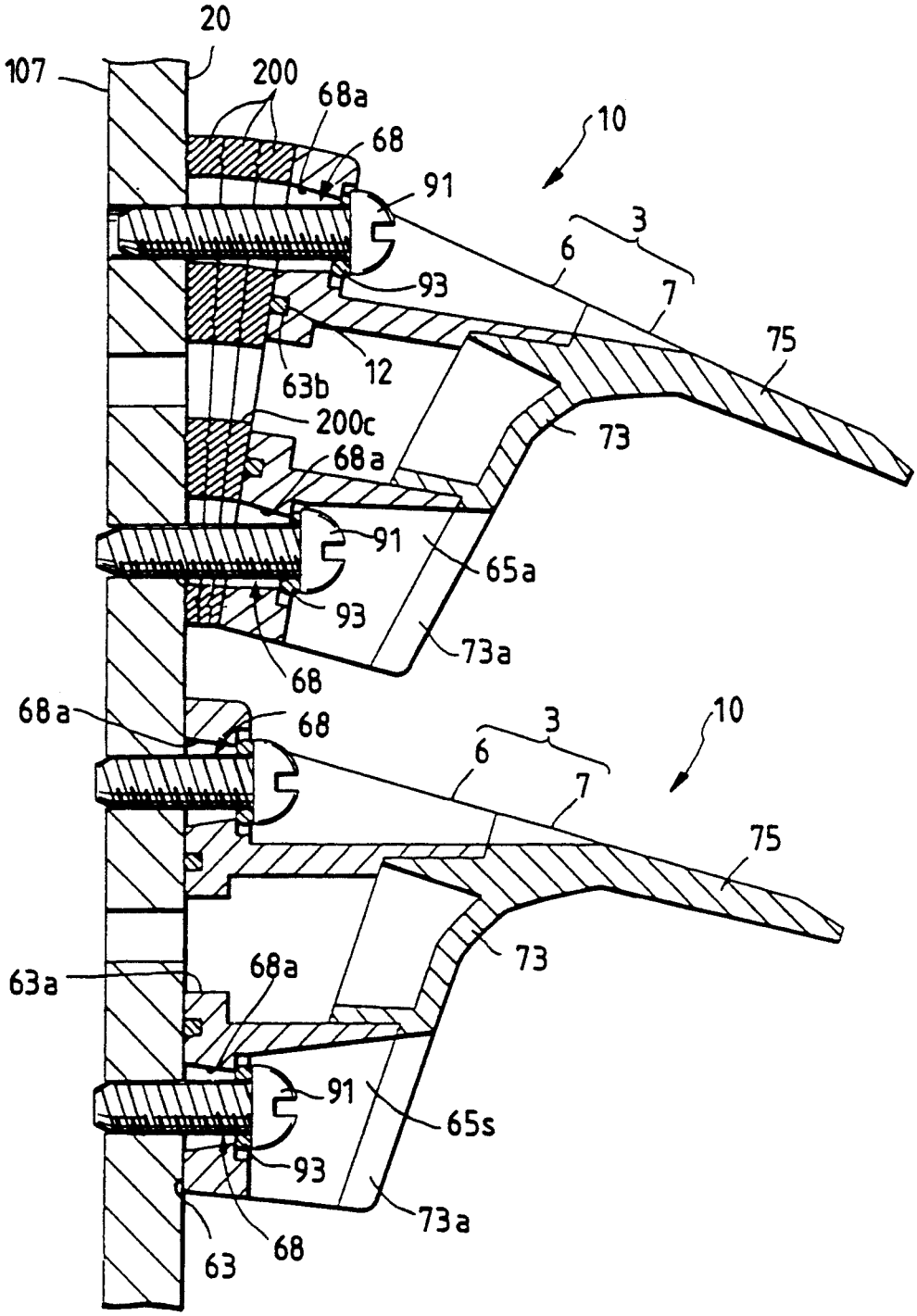
FIG. 19 is a schematic section view taken along the line B—B in FIG. 17.

As can be clearly understood from the foregoing description, in a structure for mounting an illuminant display device according to the present utility model, the illuminant display device is formed by arranging a plurality of LED illuminant elements to provide a plurality of illuminant dots arranged horizontally in line, stop member insertion holes each including tapered surfaces widening vertically toward the back end thereof are formed on the back surface side of a case frame member, with each of the stop members inclined in the range of the angle of tapering of the tapered surface. The members can be threadedly engaged at right angles with a box member to be mounted, and the illuminant dots are arranged horizontally in line respectively by mounting and wiring a large number of LED illuminant elements and can be mounted at the same angle of inclination to the box member to be mounted to thereby allow the optical axes thereof to coincide with one another. At the same time, when the illuminant display devices are arranged in upper and lower stages and mounted to the box member to be mounted to thereby construct a display unit having a large screen, the optical axes of the respective illuminant dots included in every upper and lower stages of the illuminant display devices arranged in every horizontal lines to be disposed in the upper and lower portions of the screen can be adjustably set to thereby mount the illuminant display devices in such a manner that the best visibility can be obtained at a desired practical view position. like, for example, as shown in FIG. 5. In other words, if FIG. 17 is a schematic perspective view, in partial section, of a third embodiment of an illuminant display device according to the present invention. FIG. 18 is a schematic sectional view taken along the line A—A in FIG. 17. FIG. 19 is a schematic sectional view taken along the line B—B in FIG. 17. This embodiment is similar to that of FIG. 8 except for the configuration of the hood frame 7.

More specifically, the hood frame 7 of the case frame member 5 includes a visor 75. The visor 75 is used to block the external light from above to improve the visibility of the respective illuminant dots H1 when the respective LED lamps 103*a*, 103*b* are turned on. The length of the visor 75 is set such that the incident light blocking angle $\alpha$ (an angle of incidence obtained when a horizontal surface is a reference surface) to block the direct rays of the sunlight into the illuminant dots H1 is in the range of about 45°-20° with respect to the illuminant display device 10 to be mounted in an inclined state with the box member 107 being mounted vertically. Also, in the longitudinal direction of the substantially central portion of the visor 75, there are formed a large number of ventilation holes 8 at regular intervals in three lines, to form a ventilation part.

Figure 20:
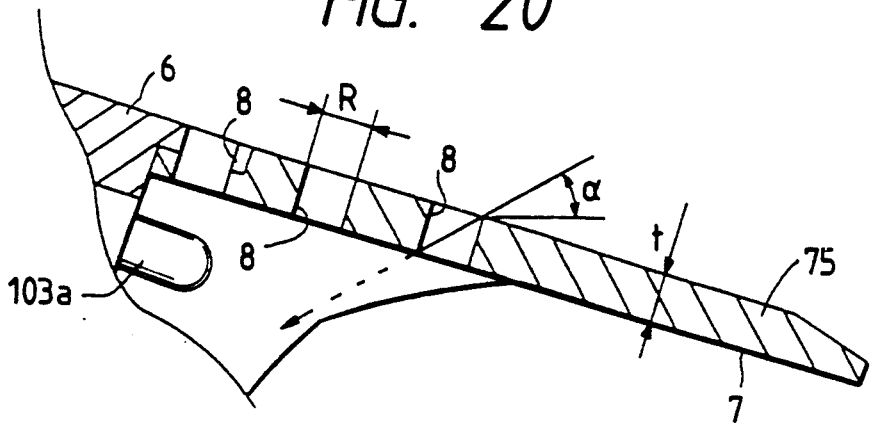
FIG. 20 is an enlarged section view of the main portions of a case frame body employed in the third embodiment.

Each of the above-mentioned ventilation holes 8, as shown in FIG. 20, is formed in a substantially cylindrical shape having a diameter R of the order of 1.5-3.0 mm when the angle of inclination of the visor 75 is 15° and the visor 75 has a thickness of 0.5-2.0 mm. The ventilation holes 8 are respectively located in the upper portion of the visor 75 and, in particular, at the positions thereof as near as possible to the LED lamps 103*a*, 103*b* mounted on the wired substrates 2. In this case, if the diameter R of the ventilation hole 8 is reduced too much or down to 1.5 mm or less, then there is a possibility that the ventilation hole 8 itself can be clogged with dust or the like. Therefore, it is practically preferable that the diameter R of the ventilation hole 8 may be at least 1.5 mm or greater. Also, the inner peripheral surface of the ventilation hole 8 is formed as a light absorbing surface of a black system or a grey system.

Figure 21:
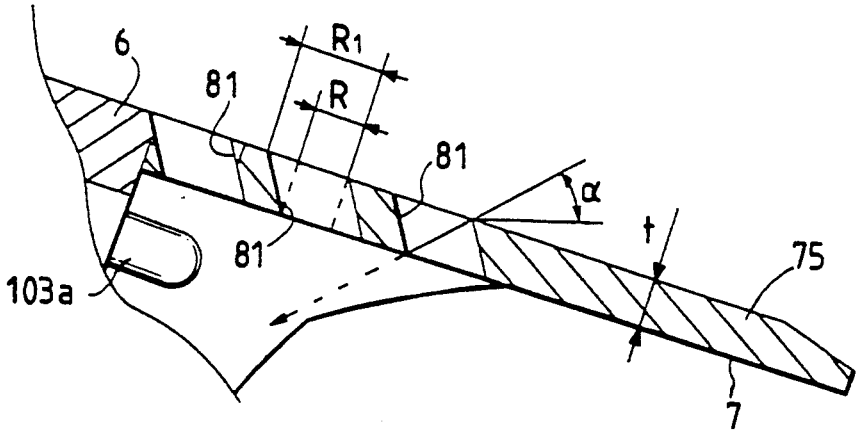
FIG. 21 is an enlarged section view of the main portions of another case frame body employed in the third embodiment.
Figure 22:
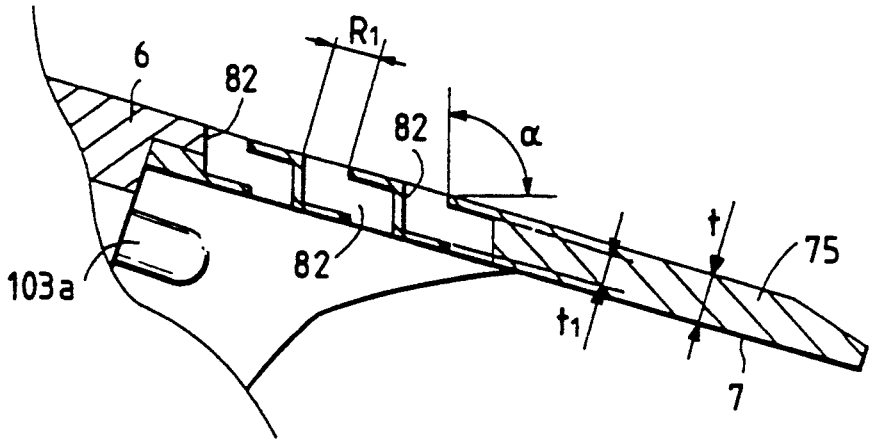
FIG. 22 is an enlarged section view of the main portions of still another case frame body employed in the third embodiment.

Alternatively, the ventilation hole may be a ventilation hole 81 as shown in FIG. 21. The ventilation hole 81 is formed such that its cross section is substantially a parallelogram with respect to the thickness t of the visor 75. In this case, in consideration of the incident angle $\alpha$ of the sunlight, that is, the leaking preventive angle of the sunlight leaking through the ventilation hole 81 and entering the illuminant part, the visor thickness t is set relatively thicker and the diameter R1 of the opening of the ventilation hole 81 is set relatively larger such that $R1>R$, whereby the open hole area of the ventilation hole 81 is secured to keep good ventilation as well as to be able to reduce the leaking incidence of the sunlight onto the illuminant part. For example, if $R=0$ is set, then it is possible to prevent the leaking incidence of most of the sunlight for the sunlight incident angle in the range of 0° to about 80°. Further, as shown in FIG. 22, the ventilation hole may be formed as a ventilation hole 82 the cross section of which is curved or substantially hook-shaped with respect to the thickness t of the visor 75. If such ventilation hole 82 is formed, then it is possible to completely prevent the leakage of the sunlight into the illuminant part in the range of the sunlight incident angles $\alpha$ of 0° to about 90°. However, in this ventilation hole 82, with the opening sections thereof R2, t1 set as 1.5 mm or more, in order to secure good ventilation and to prevent the leakage of the sunlight, the thickness t of the visor 75 must be set to be about 2.0 mm or larger.

In the illuminant display device 10 constructed in the above-mentioned manner, if the respective LED chips 103*a*, 103*b* provided on the wired substrate 2 are controlled according to a dynamic or static driving technique by an external control system to turn on the respective illuminant dots H1, then the respective LED chips 103*a*, 103*b* generate heat to thereby elevate the surface temperatures of the wired substrate 2 that are separated by the respective partition members 65, 65*a*, 73, 73*a* and thus warm up the ambient air, resulting in the convection of the air. In this case, the rising warmed air does not stay within the hood frame 7 but passes through the respective ventilation holes 8 formed in the visor 75 and is then discharged upwardly and externally of the illuminant display device 10, so that the ventilation and convection of the air can be achieved smoothly. In other words, due to the fact that the air warmed by turning on the desired illuminant dot H1 does not stay within the hood frame 7 but is surely discharged externally by means of the ventilation holes 8, the rising of the ambient air temperature within the hood frame 7 can be eased and the temperatures of the respective LED chips 103*a*, 103*b* will not rise, extraordinary so that there is reduced the possibility that the illuminant properties and lives of the LED chips can be affected by the heat generated by them. Thus, according to the present embodiment, a highly reliable illuminant display device 1 can be supplied.

Accordingly, even if a plurality of illuminant display devices 1 are disposed respectively in the upper and lower portions of the box member 107 to thereby construct a large-sized illuminant display device as shown in FIG. 16, and with each of the respective illuminant dots H1 used as a dot, desired characters, symbols and the like to be formed by dots are illuminated and displayed by an external drive circuit and an external controller (both of which are not shown), the air warmed by the respective illuminant dots H1, as shown by a one-dot chained line in FIG. 18, flows sequentially upwardly by means of a plurality of ventilation holes 8 formed in the visors 75 of the illuminant display devices 10 and are finally discharged externally of the display devices 10. That is, the heat of the air generated by the illuminant dots is released greatly into the outside air to restrict the rising of the temperatures of all of the LED devices 103*a*, 103*b*. Thus, the heat generated by the illuminant dots has no adverse effects on the illuminant properties and lives of the respective LED lamps 103*a*, 103*b*, so that there can be supplied a large-sized illuminant display device having a high reliability with respect to the heat generation. Also, if it is assumed that the temperature rising conditions are the same, then the LED lamps can be provided more densely to thereby provide an illuminant display device which has a higher illuminant brightness. In this case, if the ventilation hole 8 shown in FIG. 20 is replaced with the ventilation holes 81, 82 respectively shown in FIGS. 21 and 22, then a greater heat release effect can be provided because the ventilation holes 81, 82 respectively have a larger opening area than the ventilation hole 8.

Figure 23:
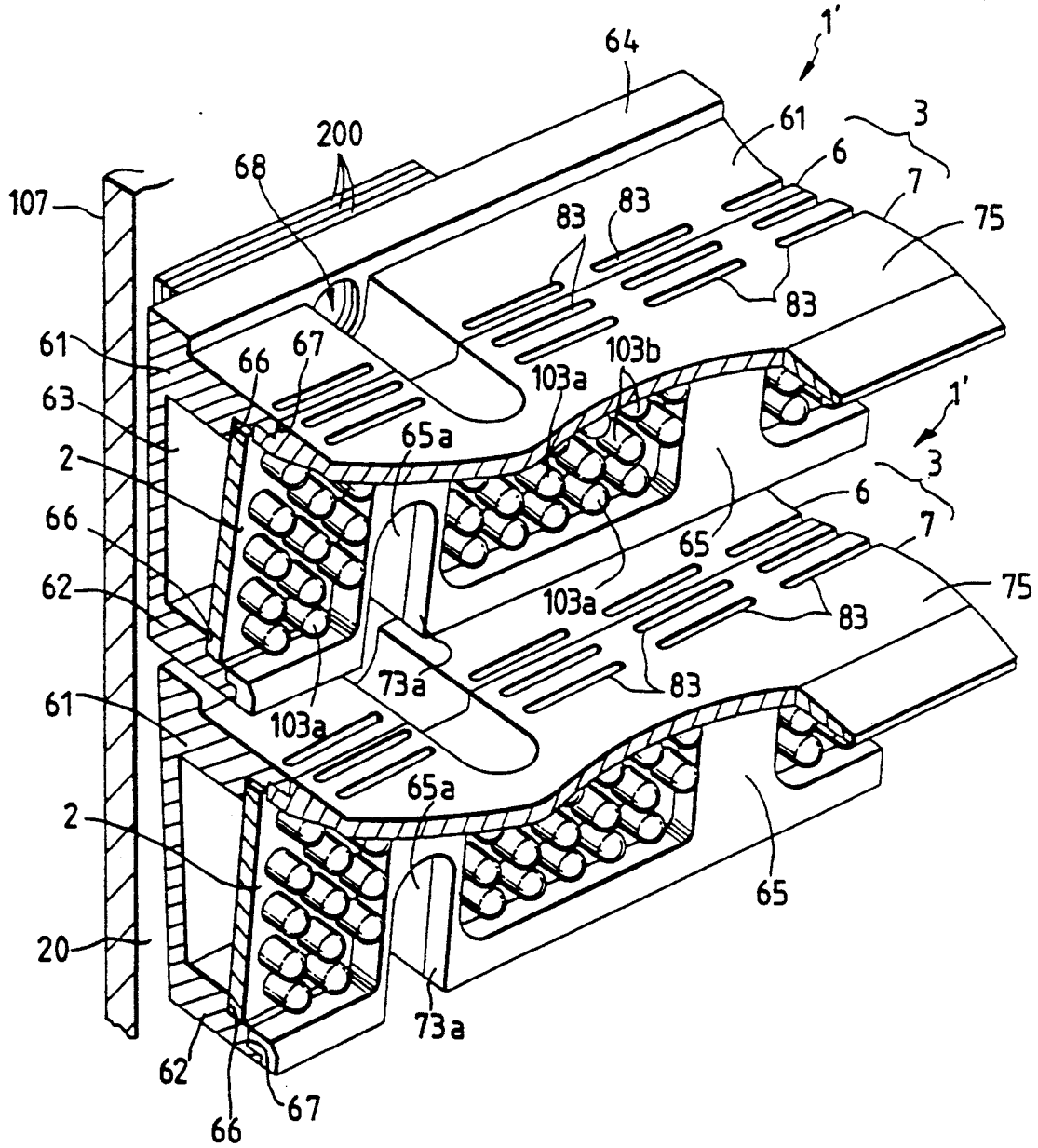
FIG. 23 is a schematic perspective view, broken in part, of modification of the third embodiment of the present invention.

Further, the ventilation part, as shown in FIG. 23, may be formed by a large number of elongated slits 83 extending in the longitudinal direction of the visor 75. In this case as well, the size of the shorter side of the slit 83 may be set similarly to FIG. 21 or FIG. 22, in consideration of FIG. 20 and the sunlight leakage preventive angle $\alpha$. With an illuminant display device 1' including such slits 83, the slit 83 provides a wider opening area than those of the respective ventilation holes 8, 81 of the above-mentioned illuminant display device 1 and thus the heat releasing efficiency can be enhanced. Also, the same heat releasing efficiency can be achieved by a smaller number of slits 83 to be formed, which is advantageous over the ventilation holes 8, 81.

In either of the above-mentioned illuminant display devices, practically, the sum of the hole areas of the ventilation hole may be at least 5% or more, preferably, on the order of 7-15% with respect to the sum of the areas of the illuminant part. If such area percentage is less than 5%, then the heat releasing effect is greatly reduced. If the percentage is set higher than 15%, then the leaking incident amount of the external light from the ventilation hole 8 becomes too great, which decreases the inherent light intercepting effect of the visor. On the other hand, when there are employed such shapes as those of the ventilation holes 81, 82 shown in FIGS. 21 and 22, then the leaking entrance of the external light can be prevented, so that the percentage can be set on the order of 15-30% to improve the ventilation efficiently. In this case, if the percentage is set 30% or more, then the heat releasing efficiency becomes saturated and, therefore, further heat releasing effect can be hardly obtained.

Figure 24:
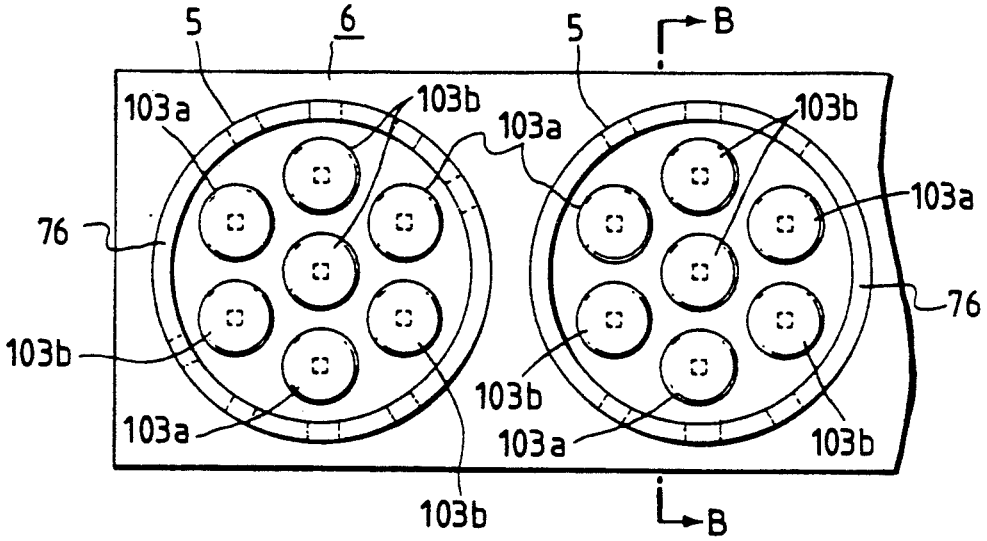
FIG. 24 is a schematic plan view of still another embodiment of an illuminant display device according to the present invention.
Figure 25:
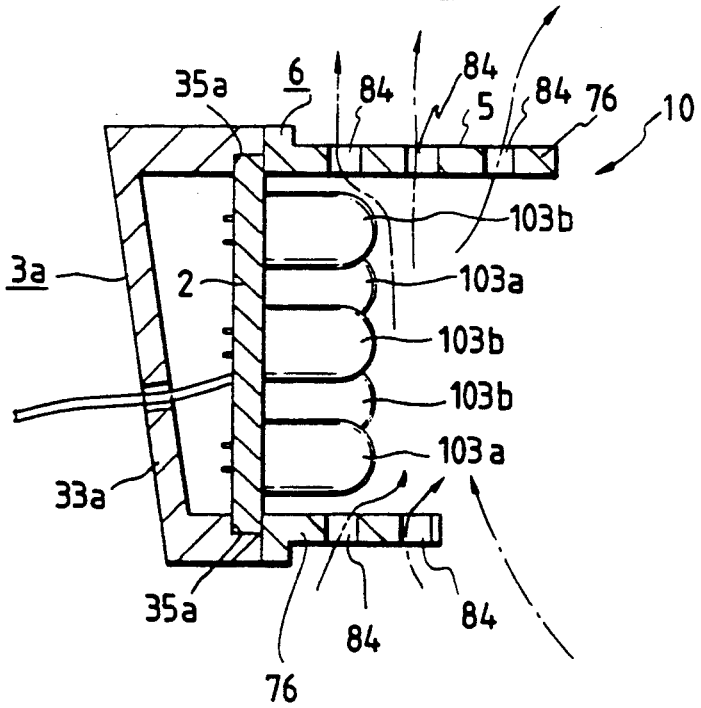
FIG. 25 is a schematic section view taken along the line C—C in FIG. 24.

Further, in the illustrated embodiment, the illuminant display device 10 is formed as an integral unit by arranging a plurality of illuminant dots H1 in lateral line. However, alternatively, a plurality of illuminant dots H1 may be arranged in longitudinal and lateral lines to construct an integral illuminant display device (not shown), for example, of $8 \times 8$ dots. In this case, similarly to the above-mentioned embodiment, a plurality of ventilation holes may be formed in visors which are provided in every lateral lines. Also, as shown in FIGS. 24 and 25, a wired substrate 2 with LED lamps 103*a*, 103*b* mounted thereon may be stored and disposed in a cylindrical case frame member 76 with a plurality of ventilation holes 84 formed at least on the upper and lower sides thereof to thereby provide an illuminant display device 10 forming an illuminant dot H1. In such illuminant display device 10 as well, the airs warmed by heat generated by turning-on of the respective LED lamps 103*a*, 103*b*, as shown by one-dot chained lines in FIG. 25, are respectively discharged through the respective ventilation holes 84 externally of the case frame member 76 or ventilated to thereby restrict the rising of the temperatures of the respective LED lamps 103*a*, 103*b*. This can eliminate the possibility that the temperature rising of the respective LED lamps 103*a*, 103*b* may have adverse effects on the illuminant properties and lives thereof.

As can be clearly understood from the foregoing description, in the illuminant display device according to the present utility model, the ambient air warmed by heat generated due to turning-on of the respective LED illuminant elements is smoothly ventilated by means of the ventilation part formed in the visor provided on the upper side of the case frame member to thereby release the heat effectively and thus to restrict the temperature vise of the ambient air within the case frame member. As a result, the heat of the respective LED illuminant elements does not have ill effects on the illuminant properties and lives thereof.

What is claimed is:

1. An illuminant display device comprising:

a wired substrate;

a plurality of LEDs mounted on said substrate;

a case frame member, said substrate being accommodated in said case frame member;

a plurality of independent illuminant dots each being composed of more than one of said LEDs, said illuminant dots being disposed along said substrate;

means for operating said illuminant dots independently of one another;

at least two stop member insertion holes, each of which has a cross section enlarged vertically toward a rear end portion thereof, and each of which is formed in a rear portion of said case frame member;

at least one spacer having a wedge-shaped cross-section interposed between said rear portion of said case frame member and a box member for accommodating a plurality of said case frame members so as to arrange said case frame members in an inclined state with respect to said box member;

stop members threadedly engaged through said stop member insertion holes at right angles to said box member to fix said case frame members to said box member.

2. The illuminant display device as defined in claim 1 wherein said spacer is provided with stop member insertion holes which are elongated in a vertical direction so as to allow said fixing members to pass therethrough.

3. The illuminant display device as defined in claim 1 wherein said case frame member comprises a visor to block external light, said visor having a plurality of through holes formed therein for ventilation.

4. The illuminant display device as defined in claim 1 wherein said illuminant dots are arranged so that centers thereof are spaced apart at a dot pitch of 15 mm to 150 mm.

5. The illuminant display device as defined in claim 1 wherein each of said illuminant dots comprises 5–100 LEDs.

6. The illuminant display device as defined in claim 1 wherein 4–16 illuminant dots are arranged in horizontal lines.

7. An illuminant device as claimed in claim 1, further comprising:

a visor portion extending over an area defined in front of said illuminant dots, said visor portion having through holes formed therein so as to facilitate ventilation.

* * * * *